United States Patent [19]

Wanner et al.

[11] 4,310,055

[45] Jan. 12, 1982

[54] PERCUSSION HAMMER WITH A ONE PIECE STRIKER

[75] Inventors: Karl Wanner, Leinfelden; Ludwig Thome, Leinfelden-Echterdingen; Jöerg Fäelchle, Bempflingen; Werner Lehmann, Leinfelden, all of Fed. Rep. of Germany

[73] Assignee: Robert Bosch GmbH, Stuttgart, Fed. Rep. of Germany

[21] Appl. No.: 67,164

[22] Filed: Aug. 16, 1979

[30] Foreign Application Priority Data

Oct. 10, 1978 [DE] Fed. Rep. of Germany ..... 2844109

[51] Int. Cl.[3] ..... B25D 9/04

[52] U.S. Cl. ..... 173/118; 173/139

[58] Field of Search ..... 173/118, 139

[56] References Cited

U.S. PATENT DOCUMENTS 3,848,931 11/1974 Swisher ..... 173/139 X 4,018,291 4/1977 Anderson ..... 173/139 X

FOREIGN PATENT DOCUMENTS 2124013 11/1971 Fed. Rep. of Germany ..... 173/118

2229388 1/1974 Fed. Rep. of Germany ..... 173/118

2351242 4/1975 Fed. Rep. of Germany ..... 173/118

2511045 9/1976 Fed. Rep. of Germany ..... 173/118

2540838 3/1977 Fed. Rep. of Germany ..... 173/139

*Primary Examiner*—Werner H. Schroeder

*Assistant Examiner*—Andrew M. Falik

*Attorney, Agent, or Firm*—Michael J. Striker

[57] ABSTRACT

A hand-held power tool has a tool holder, a tool axially reciprocable in the tool holder, and a striking mechanism including a drive piston and a striker having a disc-shaped plate with a small axial dimension and a striker shaft having a cross sectional dimension corresponding to that of a tool shaft. The striker shaft transmits impact energy directly to a rear end face of the tool shaft without an intermediate member.

20 Claims, 4 Drawing Figures

PERCUSSION HAMMER WITH A ONE PIECE STRIKER

BACKGROUND OF THE INVENTION

The present invention relates to a hand-held power tool, particularly a hammer drill and/or percussion hammer.

Hand-held power tools are known in the art, in which the striking mechanism includes an intermediate anvil or a drilling spindle located between a striker and a working tool. This intermediate element receives the impact energy from the striker and then strikes against the tool. The intermediate anvil of the hammer drill supports the working tool within the power tool during the operation against the pressure force applied by the operator. Axial impact damping is performed by a substantially elastic ring in the interior of the power tool, against which ring an annular shoulder of the intermediate anvil abuts, whereby the hard material of the tool is damped (so-called B-impact damping). The tool itself is in noise transmitting connection with the tool holder which guides and holds the same, so that vibrations are transmitted from the tool to the tool holder. Dust and dirt generated during the operation can unimpededly penetrate into the tool holder, and from it travel further into the interior of the power tool to the striking mechanism and the drive. The grease-lubricated or oil-lubricated inner parts of the power tool are considerably endangered. Premature damage and fast wear can take place as a result of this. The relatively expensive construction of the known power tool with the inner B-impact damping and intermediate anvil or drill spindle, is also disadvantageous. The high-loss transmission of the impact energy in the striking mechanism makes it necessary, in order to obtain required impact energy at the tool, to provide higher energy at the drive. The generation of noise is high, and takes place between the tool and tool holder on the one hand, and in inner system between the striker, intermediate anvil and tool, on the other hand. The striker has a diameter substantially corresponding to the diameter of the drive piston, whereas for example in the percussion hammer the intermediate anvil has a smaller diameter. This diameter differential leads in accordance with the theory of impact waves to additional losses during the transmission of the impact energy. With the given power, the desired high impact speed for the tool is not attained, which is required during the operation of the power tool with a relatively strong pressure. In addition to other disadvantages, the known hand-held power tool has a relatively complicated construction, and thereby is heavy, expensive and susceptible to failures.

SUMMARY OF THE INVENTION

Accordingly, it is an object of the present invention to provide a hand-held power tool, particularly a hammer drill and/or a percussion hammer which avoids the disadvantages of the prior art.

In keeping with these objects and with others which will become apparent hereinafter, one feature of the present invention resides, briefly stated, in a hand-held power tool in which a striker of a striking mechanism has a disc-shaped plate having a small axial dimension and a striker shaft having a cross section corresponding to that of a tool shaft and transmitting impact energy directly to an end face of the tool shaft without an intermediate member.

In such a construction the longer and thinner striker shaft can be used, and the ideal shape for the striker be attained, since substantially identical diameters of the striking part and the part to be impacted provide for extremely favorable transmission of the impact energy with the smallest possible stresses. In order to obtain a uniform recoil and return and thereby a uniformly quiet strike, the cross section of the striker shaft may be somewhat smaller than that of the tool, for example equal to 60%–80% of the tool shaft cross section. The construction provides for a higher outlet speed of the tool which makes necessary a smaller pressure in the power tool. Due to uniform recoil conditions a more quiet and uniform strike of the power tool is attained. Uniform impact power and energy per unit are obtained. An intermediate anvil or drilling spindle can be omitted so that impact enegy is directly transmitted to the tool, with a consequent substantial reduction in energy losses. Therefore, the power tool requires a smaller drive power whereby the power tool is lighter and less expensive. Due to smaller reciprocating masses the operator of the power tool is exposed to lesser vibrations.

In accordance with another feature of the present invention, the drive piston is formed as a light piston and includes a plate member having a diameter and a cross section substantially corresponding to the plate or the striker. In such a construction the drive piston is less material-consuming. The reciprocating masses are further reduced, and the power tool is more convenient and less subjected to vibrations.

Still another feature of the present invention is that the striker shaft extends into and is slidably movable in a guiding sleeve provided in a housing of the power tool. Thereby the striker, in impact position and in idle position, is guided effectively and reliably. Guiding faces of the striker shaft and the guiding sleeve which are in contact wih one another have the additional function of forming an effective seal for the interior of the power tool against penetration of dirt inwardly, and against the escape of lubricating medium, such as grease or oil, from the interior or the power tool outwardly.

Yet another feature of the present invention is that the striker shaft has a frustoconical rear end portion cooperating with a frustoconical receiving recess of the guiding sleeve. An especially advantageous feature of the present invention is that the drive piston is formed as a hollow piston and has a piston sleeve connected with the plate member, whereas the plate of the striker is sealingly and slidingly guided in the hollow piston. In such a construction a better coupling between the drive piston and the striker, and thereby better starting conditions of the striking mechanism, are attained since the striker is driven directly from the drive piston. Also, smaller air losses take place due to direct control without a trottling opening and with only one sealing point. The idle running is further improved, since the striker in the idle running position is fully uncoupled from the drive piston. Only the light piston reciprocates in the idle running, whereas the striker remains immovable. By suitable measures the striker can be braked during transition in the idle running and arrested in the idle running. A shorter idle running stroke and an effective and more quiet idle running are attained.

The inventive concept leads to a substantially simpler construction of the hand-held power tool, which is thereby lighter, cost economical and considerably less susceptible to failures. The inventive construction is suitable for a percussion hammer, as well as for a drilling-and percussion hammer.

In accordance with a further feature of the present invention the guiding sleeve may be a separate part mounted on the housing or of one piece with the latter. It can also be formed as an extension of the tool holder, particularly as an extension of a cylindrical bush of the tool holder. It is further advantageous when an elastic shaped member is arranged on an outer portion of the tool and abuts against an end face of the tool holder so as to provide axial damping between the tool and tool holder and noise damping. A jacket may surround the above mentioned shaped member and overlap a front end portion of the tool holder so as to protect the power tool from dust. Thereby, the tool is supported in the axial direction and the B-impact damping is displaced outside of the power tool. The vibration of the tool is transmitted to the tool holder less intensively. The noise reflected from the tool to the tool holder is damped to a high extent. The shaped member forms simultaneously the required abutment for axially supporting of the tool on the power tool, and outwardly displaced B-impact damping. An additional outer protection from dust is attained by the shield-like jacket of the front end of the tool holder. Thereby penetration of dirt and dust from outside into the interior of the power tool is prevented.

A further feature of the present invention is that a driven rotary sleeve and a toothed sleeve in the tool holder is provided which toothed sleeve engages the tool shaft so that the latter rotates together with and is axially movable relative to the sleeve.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF PREFERRED EMBODIMENTS

Figure 1:
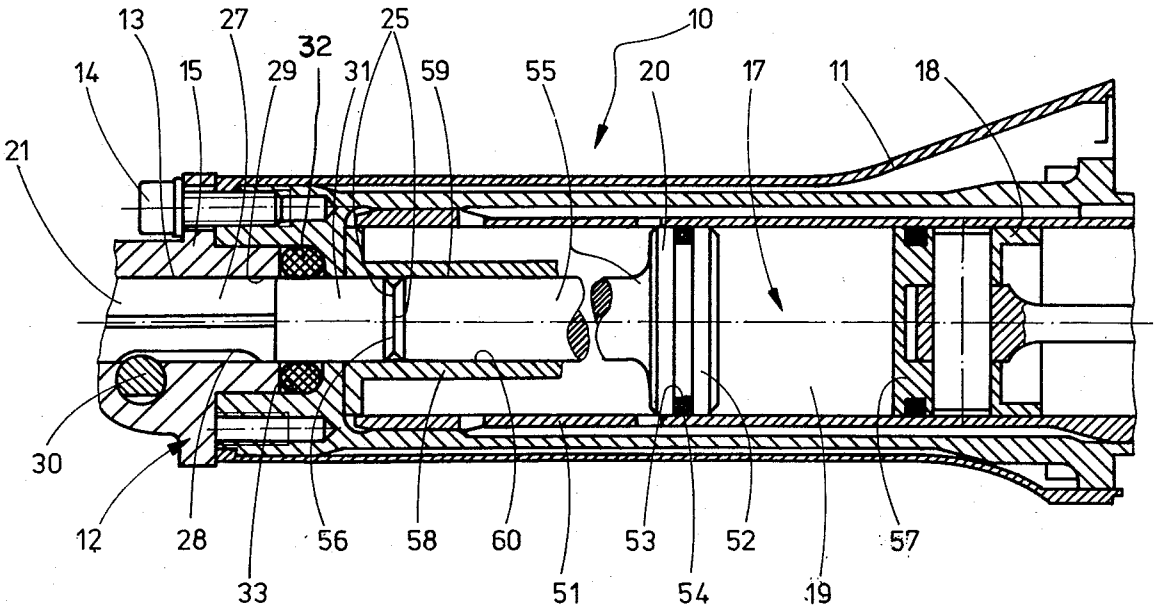
FIGS. 1, 2 and 3 are schematic axial longitudinal sections of parts of a percussion hammer in accordance with first, second and third embodiments, respectively.

FIG. 1 shows a percussion hammer which is designed as a chipping hammer 10 and has a housing 11. A tool holder 12 with a receiving recess 13 is mounted in the front region of the housing 11 by bolts 14 which extend through a flange 15. A tool 21 formed as a chisel is inserted in the receiving recess 13 of the tool holder 12. The tool 21 is accommodated non-rotatably but reciprocably relative to the tool holder 12. The tool 12 is form-lockingly secured in the tool holder against dropping out of the latter. The tool 21 has a shaft with a polygonal portion 27, for example, a hexagonal portion. This portion is provided with a longitudinal groove 28. The polygonal portion 27 extends into a polygonal opening 29 of identical shape, particularly a hexagonal opening of the tool holder 12. Thus, the tool cannot rotate but can reciprocate in the longitudinal direction.

In order to prevent dropping out of the tool and to limit the reciprocal movement of the tool 21, an arresting pin 30 extends transversely to the tool holder 12 and engages in the longitudinal groove 28 of the tool 21, as known in the conventional chipping hammers. A cylindrical portion 31 of the tool 21 is connected with the polygonal portion 27 in alignment with the latter and extends to a free end 25 of the tool shaft. The cylindrical portion 31 carries a sealing ring 32 which is received in a housing recess 33 and serves as additional sealing from losses of grease and oil. The sealing ring 32 can, however, be omitted.

Figure 2:
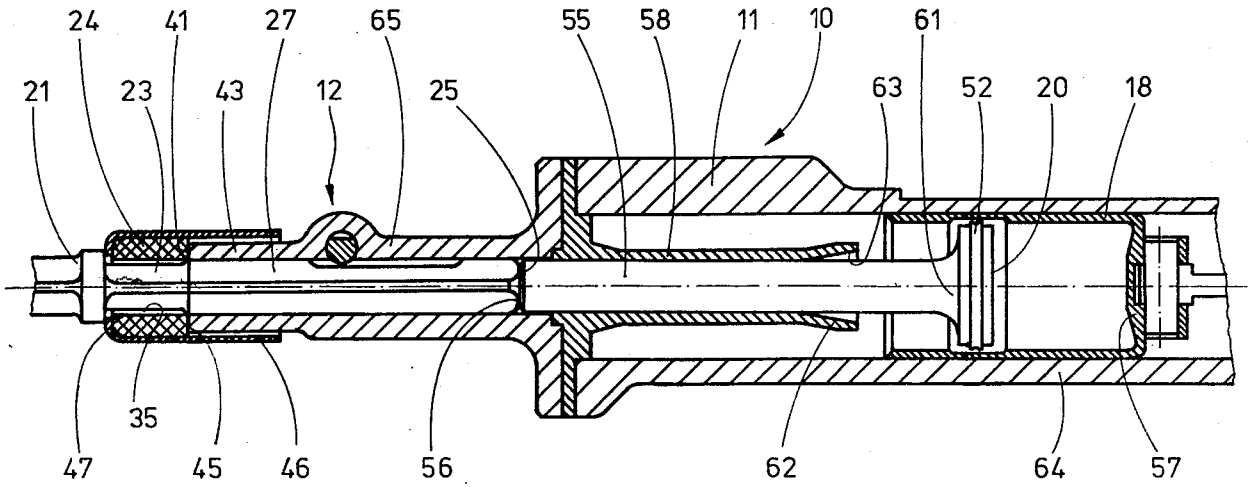

In all three embodiments of the present invention, as shown only in FIG. 2, an outer shaft portion 23 of the tool 21 carries an elastic-shaped member 24 which is firmly, but replaceably and axially movably received in a groove of the shaft portion 23. The shaped member 24 may be formed as a ring having, for example, a shape of a thick cylindrical sleeve with rounded end faces. The shaped member 24 has a side which faces toward an axial end face 41 of a front end portion 43 of the tool holder 12 and is provided with an axial annular face 45 formed as an abutment face. The annular face 45 extends in radial direction outwardly beyond the end face 41 of the front end portion 43 and acts as dust protection.

The shaped member 24 with its axial annular face 45 abuts against the end face 41 of the end portion 43 of the tool holder 12 in striking and simultaneously noise damping manner. Thereby, a so-called B-impact damping, on the one hand, and axial support of the tool 21 relative to the chipping hammer 10 with damping of vibrations between the tool 21 and the tool holder 12 are attained. The annular shaped member 24 carries at its outer peripheral face a substantially cup-shaped jacket 46 of metal or synthetic plastic material. It serves for reinforcing of the shaped member 24, and simultaneously for preventing excessive bulging of the latter. The jacket 46 extends in the direction of insertion of the shaft of the tool 21 to the front end portion 43 of the tool holder and overlaps the latter outwardly over relatively great axial length with clearance of motion and in cup-like manner. The jacket 46 acts, thereby, simultaneously as a shield-like dust protective member which overlaps the end portion 43, and as an additional noise damping member. As a result of this grease-lubricated and oil-lubricated inner parts of the shipping hammer 10 are protected from outside against dirt.

The axial length of the jacket 46 is so selected that during the operation of the chipping hammer 10 when the tool 21 moves to the left, the front end portion 43 remains overlapped by the jacket, so that the cup-like overlapping which ensures protection from dust always takes place. In the same way, this prevents penetration of dirt or dust during the operation of the chipping hammer 10 through a front opening of the receiving recess 13 and then into the interior of the chipping hammer. The jacket 46 has an annular bottom portion 47 located at a side of the shaped member 24, which side faces away from the axial end face 41 of the front end portion 43.

The shaped member 24 acts as so-called B-impact damping which, in contrast to the conventional chipping hammers, is located outside of the housing 11. Simultaneously, the shaped part 24 forms the required stop for axial abutment of the tool 21. During the operation, the tool 21 outside of the chipping hammer abuts against the tool holder 12 against the pressure applied by the operator to the chipping hammer 10. The shaped member 24 provides for extraordinary effective damping of the vibrations of the tool 21, which are transmitted to the tool holder 12 with considerably less intensity.

A striking mechanism 17 is accommodated in the housing 11 of the chipping hammer 10. It includes a drive piston 18 which is driven in reciprocating movement, and a striker 20 which is actuated by the drive piston 18 through an air cushion 19. The drive piston 18 and the striker 20 are arranged one after the other and coaxially with a cylindrical sleeve 51.

The striker 20 has a disc-shaped plate 52 with a considerably smaller axial dimension located at a side facing toward the drive piston 18. A seal 54 is accommodated in an annular groove 53 of the plate 52. The striker 20 further has a thin shaft 55 with a considerably greater axial length, which extends from the plate 32 in direction toward the tool holder. The dimension in cross-section of the striker shaft 55 corresponds to that of the shaft, for example, to the cylindrical portion 31 and the polygonal portion 27 of the tool 21. Thereby, the striker 20 has an approximately ideal shape. Since the striking part 55, on the one hand, and the parts to be impacted 31, 27, on the other hand, have an identical or at least substantially identically large cross sections, an optimum transmission of impact energy from the striking mechanism 17 is attained with the smallest possible strains in the above-mentioned parts. This leads to higher speed of the tool 21 and requires only a small pressure. This has a further advantage in a quiet and uniform stroke of the chipping hammer 10 during the operation as a result of given uniform reaction or recoil. In order to improve the uniformity of the recoil and thereby to provide uniformly quiet strokes, the cross section of the striker shaft 55 may be somewhat smaller than that of the tool 21 to be impacted. The cross section of the striker shaft 55 may be equal to 60%–80% of the cross section of the tool 21.

Especially important is that the free shaft end 25 of the tool 21 in the receiving recess is impacted directly by an end face 56 of the striker shaft 55 so as to directly transmit the impact energy. An intermediate anvil which is utilized in the conventional chipping hammers is omitted whereby the expenditures are considerably reduced. The chipping hammer 10 is substantially less expensive. At the same time, better and lower-loss transmission of the impact energy from the striking mechanism to the tool is attained.

The drive piston 18 is formed as a light piston, and is constituted of a very light material and designed with the greatest possible material economy. Because of the special construction of the striker 20 and the direct impact action upon the tool 21 without an intermediate anvil, the reciprocating masses are considerably reduced so that the optimum transmission of the energy obtained by the striking mechanism 17 takes place. The reduction of the reciprocating masses leads to considerably reduced action of vibrations upon the operator who guides the chipping hammer.

The drive piston 18 is formed as a light piston has a plate member 57 whose diameter and cross section are at least substantially so selected as to correspond to those of the plate 52 of the striker 20. A guiding sleeve 58 is located within the housing 11 and is coaxial with the striker shaft 55. The striker shaft 55 is slidingly guided in and lengthwise of the guiding sleeve. An outer peripheral face 59 of the striker shaft 55, on the one hand, and an inner peripheral face 60 of the guiding sleeve, on the other hand, cooperate with one another as guiding faces. These guiding faces together form over the relatively big length corresponding to the length of the guiding sleeve 58 and the striker shaft 55, an effective sealing of the interior of the chipping hammer 10, from penetration of dirt from outside, on the one hand, and from escape of lubricating medium such as grease or oil from the interior of the housing 11, on the other hand. Moreover, efficient guidance of the striker 20 in the striking position and in the inoperative position is guaranteed. For these reasons and also because of the additional outer protection from dust by the shaped member 24 with the jacket 46, the utilization of the additional inner sealing ring 32 is not necessary. In the embodiment shown in FIG. 1 the guiding sleeve 58 is mounted in the housing 11 as a separate part.

Figure 3:
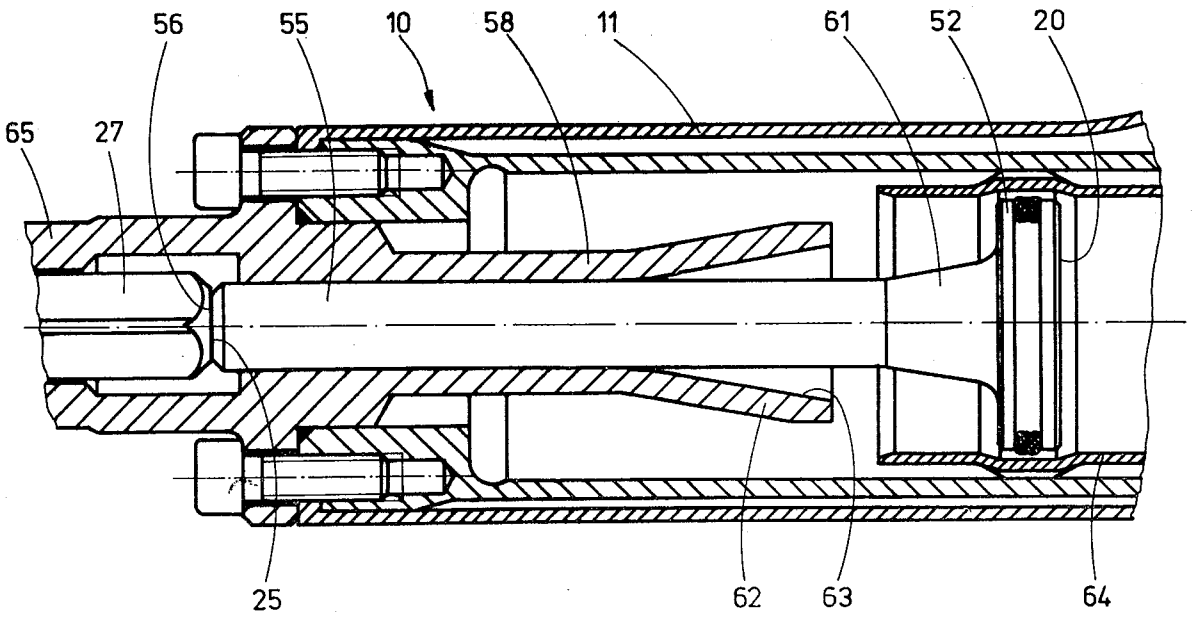

In order to avoid repetitions, parts of the second and third embodiments shown in FIGS. 2 and 3 which are identical to the parts of the embodiment of FIG. 1 are designated by identical reference numerals.

In the chipping hammer shown in FIG. 2 the guiding sleeve 58 is also mounted in the housing 11 as a separate part. The striker shaft 55 has near its plate 52, a portion 61 with a frustoconical outer peripheral face which decreases in a direction toward the lateral end 56 of the striker shaft 55. An end portion 62 of the guiding sleeve 58 which faces toward the plate 52 of the striker 20, has a frustoconical receiving recess 63 corresponding to the frustoconical portion 61 of the striker shaft 55. Because of the frustoconical portion 61 of the striker shaft 55 and the corresponding frustoconical receiving recess 63 of the guiding sleeve 58, the energy of movement of the striker 20 during transition into the idle running is substantially taken up. Thereby, a better transition into the idle running and a shorter idle stroke can be attained so that the construction can have a smaller length. Instead of or in addition to this, another braking arrangement for transition into the idle running, and a holding arrangement for idle running setting may be provided, which arrangements are not illustrated here.

Whereas in the first embodiment of FIG. 1 the plate member 57 of the drive piston 18 and also the plate 52 of the striker 20 reciprocate one after the other in the common cylindrical sleeve 51 mounted in the housing, in the chipping hammers of FIGS. 2 and 3 the drive piston 18 is formed as a hollow piston which has a piston sleeve 64 extending to the left from and of one piece with the plate member 57 in FIG. 2. The piston sleeve 64 has an axial end which faces toward the tool holder 12 and is open. The plate 52 of the striker 20 is sealingly and slidingly guided in the piston sleeve 64. Because of the formation of the drive piston 18 as a hollow piston with the plate member 57 and the piston sleeve 64, the coupling with the striker 20, formed by the plate 52 and the striker shaft 55, is further improved. This leads to an improved start and smaller air losses due to direct control without throttling bore and with only one sealing point. Efficient idle running is attained, since the striker 20 in the idle running mode lies outside of the operative range of the drive piston 18 and is fully uncoupled from the latter whereby it cannot be brought into movement from the drive piston 18. In the idle running mode the drive piston 18 formed as a light piston only reciprocates, whereas the striker 20 remains immovable. Thereby, an efficient transition into the idle running with short idle strokes and essentially quiet idle running are provided. Since the drive piston 18 during starting of the striking mechanism 17 is directly actuated from the striker 20, efficient starting conditions of the striking mechanism are attained.

The third embodiment of FIG. 3 differs from the second embodiment of FIG. 2 in that the guiding sleeve 58 of the former is of one piece with the tool holder 12, that is with its bush 65 which extends in FIG. 3 to the left and of one piece to the front end portion 43.

Figure 4:
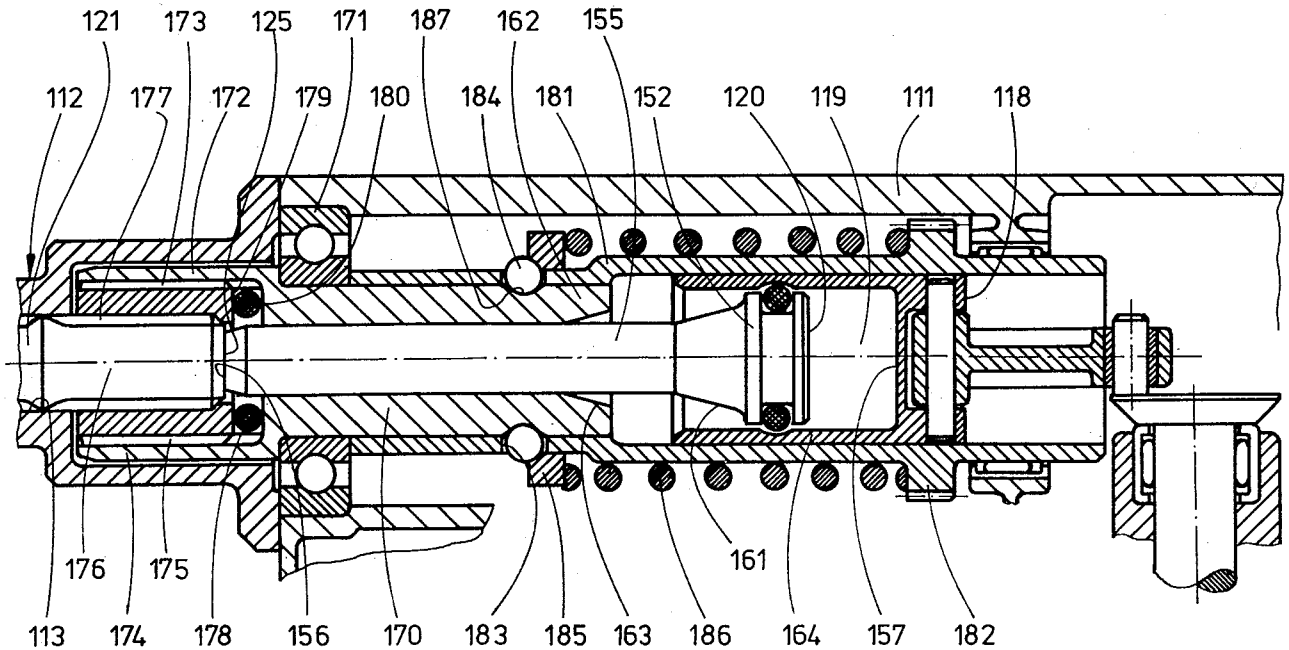
FIG. 4 is a schematic axial longitudinal section of a drilling- and percussion hammer.

The fourth embodiment of FIG. 4 shows a hammer drill and percussion hammer whose parts corresponding to the parts of the above-described embodiments are identified by reference numerals starting from 100, so as to avoid repetitions.

The hammer drill and percussion hammer of FIG. 4 has a rotary sleeve 170 located in a housing 111 and driven from a not-shown drive. The rotary sleeve 170 is supported in the housing 111 by a bearing 171. The rotary sleeve 170 is formed as a guiding sleeve for a striker shaft 155. It has a frustoconical receiving recess 163 which corresponds to frustoconical portion 161 of a striker shaft 155. The portion 161 is of one piece with an adjacent portion of the plate 152. A sleeve portion 172 of the rotary sleeve 170 is provided with an inner spline profile 173 in the groove of the tool holder 112. A toothed sleeve 174 is located inside the sleeve portion 172 and coupled with the latter in the peripheral direction. The toothed sleeve 174 engages with an outer spline profile 175 in the spline profile 173 of the sleeve portion 172 so as to transmit torque. The toothed sleeve 174 is substantially in alignment with a receiving recess 113 of the tool holder 112.

A tool 121 has a grooved portion 176 provided, for example, with longitudinal grooves inclined at an angle substantially equal to 8°. The toothed sleeve 174 has an inner receiving formation, for example, longitudinal teeth 177 also inclined at 8 °. The latter engage in the grooves of the shaft portion 176 so as to transmit torque in such a manner, however, that the tool 121 remains reciprocable relative to the toothed sleeve 174. An axial O-ring 178 formed as a damping member and acting as B-impact damping is arranged between the toothed sleeve 174 and the rotary sleeve 170 acting as a guiding sleeve for the striker shaft 155. The toothed sleeve 174 with its end face 179, and the rotary sleeve 170 with its annular shoulder 180 in the region of transition from the rotary sleeve 170 to the sleeve portion 172 abuts against the O-ring 178.

In accordance with the fourth embodiment, a drive piston 118 is also formed as a hollow piston. It is composed of a plate member 157 with a one-piece piston sleeve 164 extending to the left in FIG. 4. A plate 152 of a striker 120 is guided in the piston sleeve 164 sealingly and movably in a longidutinal direction. The drive piston 118 with the plate member 157 and the piston sleeve 164 is, in turn, accommodated and guided in a coaxial rotary tube 181. The latter receives a rotary sleeve 170 which acts as a guiding sleeve for the striker shaft 155. The rotary tube 181 is driven through an outer gear 182 from a not shown drive and is coupled with the rotary sleeve 170 by means of an interengaging coupling so as transmit torque. This coupling has balls 184 which are held in radial holes 183 of the rotary tube 181. The balls 184 are pressed radially inwardly by a pressing ring 185. The latter is biased by a spring 186 which in the bottom region of the gear 182 axially abuts against the rotary tube 181 and spring-biases the pressing ring 185 to the left in FIG. 4. The rotary sleeve 170 has on its periphery and at the height of the balls 184, depressed sperical pockets 187 in which the balls engage.

The rotary drive of the tool 121 is thereby provided through the rotary driven rotary shaft 181, the interengaging coupling with the balls 184, the rotary sleeve 170 with the sleeve portion 172, through which the outer spline profile 175 of the toothed sleeve 174 engages with the inner spline profile 173, and through the toothed sleeve 174 and the longitudinal teeth 177 to the shaft portion 176. The axial impact action of the tool 121 is attained in the similar way, as in the chipping hammer of FIGS. 1–3. Namely, this action is provided through the axially reciprocable drive piston 118, the air cushion 119 in the interior of the piston sleeve 164, the plate 152 of the striker 120 with the striker shaft 155 which with its left lateral end 156 directly strikes the free shaft end 125 of the shaft portion 176.

It will be understood that each of the elements described above, or two or more together, may also find a useful application in other types of constructions differing from the types described above.

While the invention has been illustrated and described as embodied in a hammer drill and/or a percussion hammer, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A hand-held power tool, particularly a hammer drill and/or a percussion hammer, comprising a tool holder having an axis; a tool axially reciprocable in said tool holder and having a tool shaft with a rear end face; a housing having a guiding sleeve and a cylindrical sleeve wherein substantially the entire length of the guiding sleeve is located within said cylindrical sleeve; and a striking mechanism including an axially reciprocating drive piston located within said cylindrical sleeve and a striker actuated by said drive piston via an air cushion, said striker having a disc-shaped plate at its end facing toward said drive piston, and a striker shaft extending toward said tool holder, said disc-shaped plate of said striker having a relatively small axial dimension, said striker shaft having a cross-section whose dimension at least substantially corresponds to that of said tool shaft, said striker shaft being arranged to transmit impact energy directly to said rear end face of said tool shaft without an intermediate member, said striker shaft extending into and being slidably movable in said guiding sleeve lengthwise of the latter, said striker shaft having a front end face arranged to strike against said rear end face of said tool shaft, and a frustoconical rear end portion adjacent to said plate of said striker, said frustoconical rear end portion reducing in the direction toward said tool and toward said front end of said striker shaft.

2. A power tool as defined in claim 1, and further comprising means for preventing dropping out of said tool from said tool holder and including formations provided in the former and in the latter and form-lockingly engaging each other.

3. A power tool as defined in claim 1, wherein said drive piston is formed as a light piston and includes a plate member having a diameter and a cross section which substantially correspond to those of said plate of said striker.

4. A power tool as defined in claim 3, wherein said drive piston is formed as a hollow piston and has a piston sleeve connected with said plate member, said hollow piston having an open end which faces toward said tool holder.

5. A power tool as defined in claim 4, wherein said plate of said striker is sealingly and slidingly guided in said hollow piston.

6. A power tool as defined in claim 1, wherein said striker shaft has an outer surface and said guding sleeve has an inner surface, said outer and inner surfaces being formed as sealing surfaces so as to prevent penetration of dirt from outside into the interior of the power tool, and escape of lubricating medium from inside of the power tool outwardly thereof.

7. A power tool as defined in claim 1, wherein said striker with said plate and said drive piston with said plate member are arranged and guided in said cylindrical sleeve coaxially therewith.

8. A power tool as defined in claim 1, wherein said guiding sleeve is a separate member which is mounted to a remaining part of said housing.

9. A power tool as defined in claim 1, wherein said tool has an outer portion extending outwardly beyond said housing; and an impact damping arrangement including an outer shaped member which is firmly held on said outer portion of said tool and constituted of an elastic material, said tool holder having an outer end face, and said shaped member having an outer abutment face abutting against said outer face of said tool holder so as to provide axial damping between said tool and said tool holder and simultaneously noise damping.

10. A power tool as defined in claim 9; and further comprising a cup-shaped jacket surrounding said shaped part and extending in the direction of elongation of said tool, said tool holder having a front end portion which is overlapped by said jacket with clearance of motion and in cup-like manner so as to provide protection from dust.

11. A hand-held power tool as defined in claim 1, wherein said guiding sleeve is of one piece with said tool holder.

12. A hand-held power tool as defined in claim 1, wherein said guiding sleeve is formed as a coaxial extension of said tool holder and provided with an inner polygonal hole, said tool shaft having a polygonal portion which substantially corresponds to and is received in said polygonal hole so that said tool is nonrotatably but axially movably received in said tool holder.

13. A power tool as defined in claim 12, wherein said tool holder has an elongated bush, said guiding sleeve being formed as an extension of said elongated bush.

14. A power tool as defined in claim 13, wherein said polygonal portion of said tool shaft has a longitudinal groove; and further comprising an arresting pin in said elongated bush and engaging in said longitudinal groove transversely to the latter so as to prevent dropping out of said tool from and to axially limit the reciprocation of said tool relative to said tool holder.

15. A hand-held power tool, particularly a hammer drill and/or a percussion hammer, comprising a tool holder having an axis; a tool axially reciprocable in said tool holder and having a tool shaft with a rear end face; a housing having a guiding sleeve; a striking mechanism including an axially reciprocating drive piston and a striker actuated by said drive piston via an air cushion, said striker having a disc-shaped plate at its end facing toward said drive piston, and a striker shaft extending toward said tool holder, said disc-shaped plate of said striker having a relatively small axial dimension, said striker shaft having a cross-section whose dimension at least substantially corresponds to that of said tool shaft, said striker shaft being arranged to transmit impact energy directly to said rear end face of said tool shaft without an intermediate member, said striker shaft extending into and being slidably movable in said guiding sleeve lengthwise of the latter; and a driven rotary tube coupled to a rotary sleeve by a spring biased ball means wherein said rotary sleeve acts as a guiding element for the striker shaft with the latter coaxially located therein, with the inside end portion of said rotary sleeve being formed with a toothed surface which engages a splined tool shaft.

16. A power tool as defined in claim 15, wherein said drive piston has a plate member and a piston sleeve connected to said plate member, with said sleeve being axially located within said rotary tube, said guiding sleeve being also located in said rotary tube and engaging the latter for transmission of torque.

17. A power tool as defined in claim 15; and further comprising an axial damping member arranged between said toothed sleeve and said guiding sleeve, said toothed sleeve having an end face facing toward said drive piston and said guiding sleeve having an annular shoulder facing toward said tool holder which end faces abut against said axial damping member.

18. A power tool as defined in claim 17, wherein said axial damping member is an O-ring.

19. A power tool as defined in claim 17, wherein said annular shoulder is located in the region of transition from said guiding sleeve to said sleeve portion.

20. A hand-held power tool, particularly a hammer drill and/or a percussion hammer, comprising a tool holder having an axis; a tool reciprocable in said tool holder and having a tool shaft with a rear end face; a housing having a guiding sleeve; and a striking mechanism including an axially reciprocating drive piston and a striker actuated by said drive piston via an air cushion, said striker having a disc-shaped plate at its end facing toward said drive piston, and a striker shaft extending toward said tool holder, said disc-shaped plate of said striker having a relatively small axial dimension, said striker shaft having a cross-section whose dimension at least substantially corresponds to that of said tool shaft, said striker shaft being arranged to transmit impact energy directly to said rear end face of said tool shaft without an intermediate member, said striker shaft extending into and being slidably movable in said guiding sleeve lengthwise of the latter, said striker shaft having a frustoconical rear end portion located adjacent to said plate of said striker and reducing in the direction toward said tool, said guiding sleeve including an end portion facing toward said plate of said striker and having a receiving recess which is frustoconical and substantially corresponds to said frustoconical end portion of said striker shaft.

* * * * *